US006278088B1

(12) United States Patent
Eller et al.

(10) Patent No.: US 6,278,088 B1
(45) Date of Patent: Aug. 21, 2001

(54) ROD GLOW PLUG

(75) Inventors: Martin Eller; Martin Allgaier, both of Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/503,735

(22) Filed: Feb. 15, 2000

(30) Foreign Application Priority Data

Feb. 19, 1999 (DE) ..... 199 07 229

(51) Int. Cl.[7] ..... F23Q 7/00

(52) U.S. Cl. ..... 219/270; 123/145 A; 29/611; 29/613; 219/544; 219/546

(58) Field of Search ..... 219/270, 544, 219/542, 550, 546; 123/145 A, 145 R; 361/264–266; 29/611, 613

(56) References Cited

U.S. PATENT DOCUMENTS 4,476,378 10/1984 Takizawa et al. .

FOREIGN PATENT DOCUMENTS

| | | | | |
|---|---|---|---|---|
| 1 825 999 | | 2/1961 | (DE) . | |
| 34 13 850 | | 10/1984 | (DE) . | |
| 4036162 | * | 5/1992 | (DE) | 219/270 |
| 1 413 147 | | 2/1991 | (EP) . | |
| 859659 | * | 1/1961 | (GB) | 219/270 |
| 927336 | * | 1/1962 | (GB) | 123/145 A |
| 58-21 | | 1/1983 | (JP) . | |
| 60-86327 | * | 5/1985 | (JP) | 219/270 |

* cited by examiner

*Primary Examiner*—John A. Jeffery
(74) *Attorney, Agent, or Firm*—Nixon Peabody LLP; David S. Safran

(57) ABSTRACT

A rod glow plug comprises a glow tube, inner heating coil(s) and optionally control coil(s), and a terminal pole which leads into the glow tube, the coil(s) being connected to the terminal pole and glow tube tip, there being a stabilizer rod (10) which extends in an assembly stage from the terminal pole (9) to the glow tube tip, optionally into an opening in the glow tube tip or through it, and the stabilizer rod (10) being located essentially in the middle running through the coil(s).

20 Claims, 3 Drawing Sheets

FIG. 3
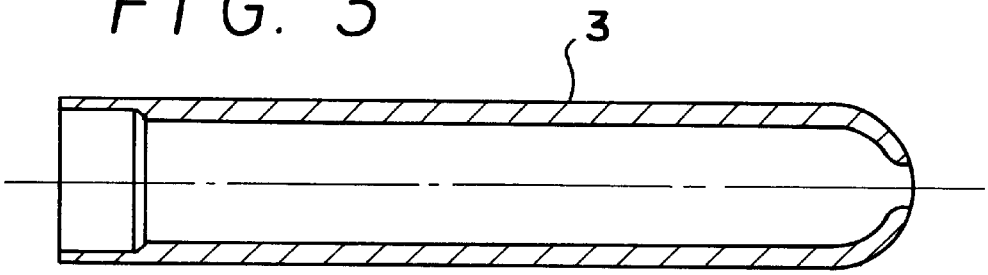
PRIOR ART
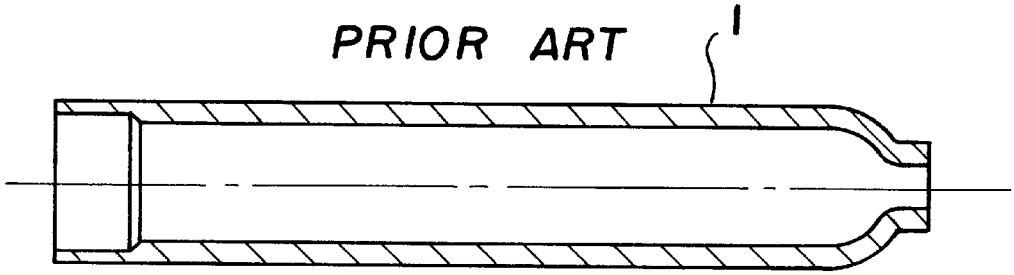
FIG. 1
PRIOR ART
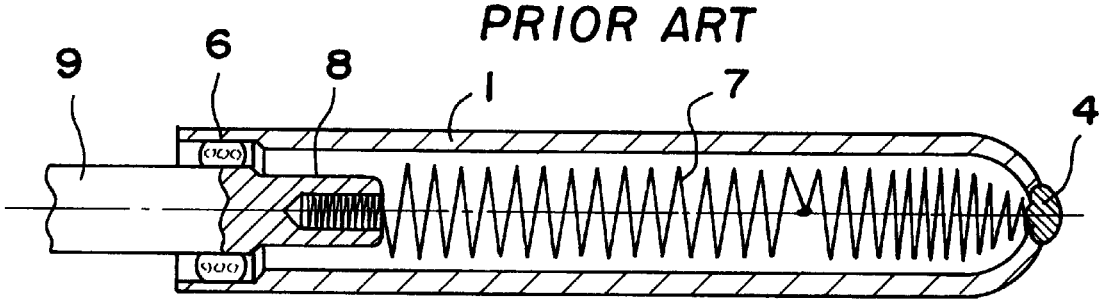
FIG. 2

FIG. 8
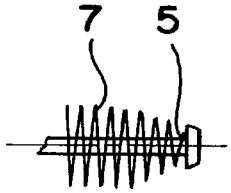
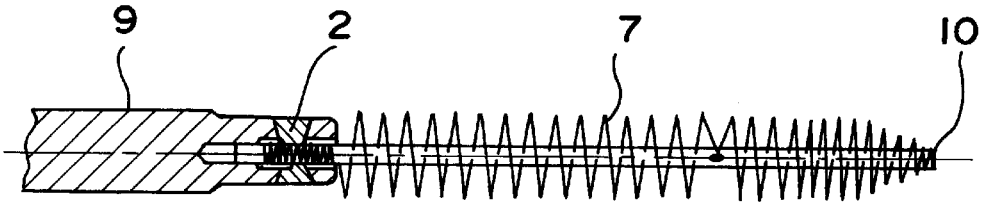
FIG. 9
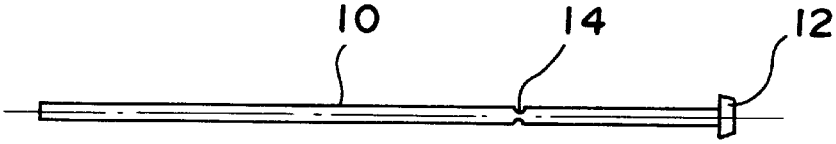
FIG. 10

ROD GLOW PLUG

BACKGROUND OF THE INVENTION

1. Field of the Invention

[0001] The present invention is directed to a rod glow plug with a glow tube.

2. Description of the Prior Art

[0002] Rod glow plugs are generally known and have a glow tube in which there are heating coil(s) and optionally control coil(s) series connected to one another, the coils in the terminal-side area being connected to one terminal pole and in the glow tube tip being connected to the glow tube. Conventionally, the coils are embedded within the glow tube in an electrically insulating conductive material. In the area of the glow tube tip it first of all has an opening in which the coil end on the side of the combustion space is welded to the glow tube with the formation of a welding spot. This welding spot causes a heavy accumulation of material which adversely affects the preheating time of the plug. The high welding energy which must be applied for welding of the glow tube and the heating coil is likewise disadvantageous. Especially for long rod glow plugs and/or for heating coils with thin wires, centering of the heating coil in the area of the welding spot represents a major problem, the rod glow plugs often being faulty when the heating coil is not exactly centered.

SUMMARY OF THE INVENTION

[0003] An object of the invention is to overcome the indicated defects in the prior art and to make available a rod glow plug with a coil which is centered very accurately, and scrap due to poor centering of the coil being greatly reduced in its production.

[0004] These and other objects are achieved in accordance with the present invention by providing rod glow plug with a glow tube, inner heating coil(s) and optionally control coil(s), and a terminal pole which leads into the glow tube, the coil(s) being connected to the terminal pole and the glow tube tip, characterized in that there is a stabilizer rod which extends in an assembly stage from the terminal pole to the glow tube tip, optionally into an opening in the glow tube tip or through it, and the stabilizer rod being located essentially in the middle running through the coil(s).

[0005] By welding the glow tip to the heating coil with the stabilizer rod in accordance with the present invention, the rod glow plug in accordance with the present invention has less material accumulation than in conventional welding; in addition, the new stabilizer rod of the rod glow plug in accordance with the present invention enables small-space, localized welding techniques, as for example, laser welding. Thus, when welding the heating coil of the rod glow plug in accordance with the present invention with the stabilizer rod, more accurate resistance values arise than in conventional welding with resulting undefined welding spot.

[0006] In the installation of the rod glow plug in accordance with the present invention with a stabilizer rod, the heating coil is advantageously held still and accurately centered; the fracture site of the stabilizer rod provided in a special embodiment leads to its reliable separation in the sealing of the heating rod by for example swaging and thus to prevention of short circuits. In addition, the use of the stabilizer rod in the rod glow plug in accordance with the present invention leads to desirable uniform heat dissipation due to the lower material accumulation at the glow tube tip during welding and due to the exact centering of the heating coil in the glow tube.

BRIEF DESCRIPTION OF THE DRAWINGS

[0007] FIG. 1 is a schematic longitudinal section through a prior art glow tube which is open on the combustion space side, with a weld deposit;

[0008] FIG. 2 is a schematic longitudinal section through the glow tube as shown in FIG. 1 with an inside heating coil and terminal pole with a welding spot in the glow tube tip;

[0009] FIG. 3 is a schematic longitudinal section through a glow tube without a weld crust;

[0010]

[0011]

[0012]

[0013]

Figure 5:
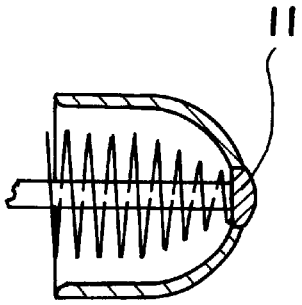
FIG. 5 is a schematic cross section through the glow tube tip as shown in FIG. 4 after welding.

[0014] FIG. 8 schematically shows the welding of the heating coil with the stabilizer head;

[0015] FIG. 9 schematically shows the assembly of the stabilizer rod, coil and terminal pole; and

[0016] FIG. 10 is a side view of a stabilizer rod with a head and scoring of a rod glow plug in accordance with the present invention.

DETAILED DESCRIPTION OF THE PREFERRED EMBODIMENTS

[0017] As shown in FIG. 2, a conventional rod glow plug has a glow tube 1 which, as shown in FIG. 1, is provided with a welding filler in the area of one opening in the glow tube tip. In the glow tube there are one or more heating and/or control coils 7, the coil end area in the direction to the combustion space side being attached in the opening with the formation of a welding spot 4 for fixing and contact-making to the glow tube, while the terminal-side area is fixed by contact-making in a terminal pole 9, the terminal pole 9 projecting partially into the interior of the glow tube 1; the latter is scaled with a seal 6 against penetration of moisture and air, within the glow tube a filler material 8 being placed, the coils 7 being embedded in the filler material which is conventionally electrically insulating, but has good heat conductivity. In the terminal-side area the coil end is fixed by caulking in one hole of the inner pole 9.

[0018] The rod glow plug in accordance with the present invention has, as shown in FIG. 9, a stabilizer rod 10 which extends from the terminal pole 9 in the middle through the turns of the coils 7. FIG. 10 shows one especially preferred embodiment of a stabilizer rod 10 in accordance with the present invention, its having a head 12 and scoring 14, the latter breaking by swaging in the further course of producing the rod glow plug, especially in the subsequent sealing of the heating rod. In this embodiment the coil end on the combustion space side, as shown in FIG. 8, is spot welded 5 on the head 12.

Figure 4:
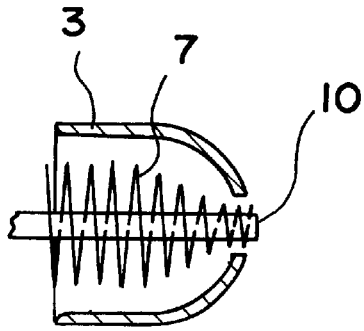
FIG. 4 is a schematic longitudinal section through a glow tube tip with a coil and stabilizer rod in accordance with the present invention.
Figure 7:
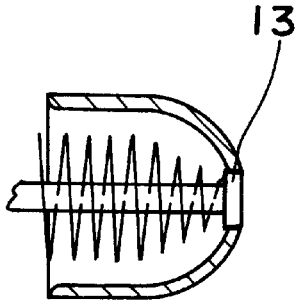
FIG. 7 is a schematic cross section through the glow tube tip as shown in FIG. 6 after welding.
Figure 6:
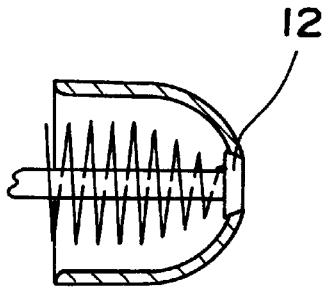
FIG. 6 is a schematic cross section through the glow tube tip with a stabilizer rod in accordance with the present invention with a head.

[0019] FIGS. 4 and 5 show the insertion of the stabilizer rod end on the combustion space side with the adjoining coil end area into/through the opening of the glow tube tip and its welding which leads to the defined welding spot 11. FIGS. 6 and 7 show the same thing using the stabilizer 10 with the head 12; here, funnel-shaped formation of the opening in the glow tube tip is advantageous with simultaneous plug-shaped formation of the insulator rod head 12.

The welding 13 of the head 12 in the opening takes place preferably by laser welding.

[0020] In all embodiments, also in the terminal-side area, installation advantages and improved electrical contact-making are achieved when the terminal-side end of the stabilizer 10 is connected to the terminal-side coil end or is welded closely wound in a hole in the terminal pole 9; here, accordingly, either only the terminal-side end of the coil or coil end together with the stabilizer rod end can be welded to the terminal pole 9. In particular, it is especially preferred if welding of the control coil 7 is done with or without the end section of the stabilizer 10 in the terminal pole 9 as laser welding and here especially without additional welding fillers; in this case the wall thickness of the hole in the inner pole can be designed to be correspondingly small.

What is claimed is:

1. A rod glow plug comprising:

a glow tube;

a terminal pole which projects at least partially into an interior area of the glow tube;

at least one inner heating coil connected to the terminal pole and to a tip of the glow tube;

a stabilizer rod which extends longitudinally through the at least one inner heating coil from the terminal pole to the tip of the glow tube, wherein the stabilizer rod has scoring for enabling the stabilizer rod to separate for prevention of short circuits.

2. The rod glow plug as claimed in claim 1, further comprising at least one inner control coil connected in series to the at least inner heating coil.

3. The rod glow plug as claimed in claim 2, wherein the stabilizer rod extends from the terminal pole through an opening at the tip of the glow tube.

4. The rod glow plug as claimed in claim 1, wherein the stabilizer rod extends from the terminal pole through an opening at the tip of the glow tube.

5. The rod glow plug as claimed in claim 4, wherein a distal end of the stabilizer rod includes an insulator rod head in sealing engagement with the opening at the tip of the glow tube on a combustion space side of the glow tube.

6. The rod glow plug as claimed in claim 5, wherein a distal end of the at least one inner heating coil is rigidly attached to a distal end of the stabilizer rod on the combustion space side of the glow tube.

7. The rod glow plug as claimed in claim 6, wherein the distal end of the at least one inner heating coil is laser welded to the insulator rod head on the combustion space side of the glow tube.

8. The rod glow plug as claimed in claim 7, wherein the distal end of the stabilizer rod is welded to the tip of the glow tube.

9. The rod glow plug as claimed in claim 8, wherein a terminal-side end area of the at least one inner heating coil is welded to an end of the terminal pole.

10. The rod glow plug as claimed in claim 9, wherein a terminal-side end area of the stabilizer rod is rigidly attached to the terminal-side end area of the at least one inner heating coils.

11. The rod glow plug as claimed in claim 10, wherein a terminal-side end area of the stabilizer rod is welded in a hole at an end face of the terminal pole.

12. A method of producing a rod glow plug comprising the steps of:

providing a glow tube and a terminal pole which projects at least partially into the glow tube;

providing at least one inner heating coil connected to the terminal pole and to a tip of the glow tube, providing a stabilizer rod;

scoring a surface of the stabilizer rod;

inserting the stabilizer rod into the glow tube, the stabilizer rod extending longitudinally through the at least one inner heating coil from the terminal pole to the tip of the glow tube;

swaging the stabilizer rod so as to break the stabilizer rod at the scored surface and thereby prevent short circuiting during operation of the rod glow plug.

13. The method of producing a rod glow plug as claimed in claim 12, wherein the step of providing at least one inner heating coil includes providing at least one inner control coil connected in series to the at least inner heating coil.

14. The method of producing a rod glow plug as claimed in claim 13, wherein the stabilizer rod extends from the terminal pole and is inserted into an opening at the tip of the glow tube.

15. The method of producing a rod glow plug as claimed in claim 12, wherein the stabilizer rod extends from the terminal pole and is inserted into an opening at the tip of the glow tube.

16. The method of producing a rod glow plug as claimed in claim 12, wherein a distal end of the stabilizer rod includes an insulator rod head which is placed in sealing engagement with the opening at the tip of the glow tube on a combustion space side of the glow tube.

17. The method of producing a rod glow plug as claimed in claim 16, wherein the step of providing at least one inner heating coil includes rigidly attaching a distal end of the at least one inner heating coil to a distal end of the stabilizer rod on the combustion space side of the glow tube.

18. The method of producing a rod glow plug as claimed in claim 17, wherein the step of rigidly attaching a distal end of the at least one inner heating coil includes laser welding the distal end of the at least one inner heating coil to the insulator rod head on the combustion space side of the glow tube.

19. The method of producing a rod glow plug as claimed in claim 18, wherein after the step of inserting the stabilizer rod includes welding the distal end of the stabilizer rod to the tip of the glow tube.

20. The method of producing a rod glow plug as claimed in claim 19, wherein the step of providing at least one inner heating coil includes welding a terminal-side end area of the at least one inner heating coil to an end of the terminal pole.

* * * * *